United States Patent [19]

Nordgren

[11] Patent Number: 4,475,703

[45] Date of Patent: Oct. 9, 1984

[54] SPACER FOR LOADING PALLETS

[76] Inventor: Hans-Elov Nordgren, Ovanåker, 82800 Edsbyn, Sweden

[21] Appl. No.: 585,637

[22] Filed: Mar. 8, 1984

Related U.S. Application Data

[63] Continuation of Ser. No. 294,516, Aug. 20, 1981.

[51] Int. Cl.[3] ..... F16M 11/20

[52] U.S. Cl. ..... 248/188.1; 108/56.1; 108/51.3

[58] Field of Search ..... 248/188.8, 174, 188.1; 108/513, 56.3, 56.1; 206/599, 600

[56] References Cited

U.S. PATENT DOCUMENTS

| | | | |
|---|---|---|---|
| 3,123,020 | 3/1964 | Voissem | 108/56.1 |
| 3,587,749 | 6/1971 | Geschwender | 108/51.3 |
| 3,641,948 | 2/1972 | Brown | 108/56.1 X |
| 3,835,791 | 9/1974 | Brown | 108/56.1 |
| 4,102,525 | 7/1978 | Albano | 108/51.3 X |
| 4,292,900 | 10/1981 | Bula | 248/188.8 X |
| 4,333,622 | 6/1982 | Albano | 248/188.8 |
| 4,348,442 | 9/1982 | Figge | 108/56.1 X |

FOREIGN PATENT DOCUMENTS

| | | | |
|---|---|---|---|
| 2326607 | 4/1977 | France | 108/56.1 |

*Primary Examiner*—Ramon S. Britts
*Assistant Examiner*—Sarah A. Lechok
*Attorney, Agent, or Firm*—Cohn, Powell & Hind

[57] ABSTRACT

A spacer for loading pallets comprises a tubular member having a number of pointed securing tabs (3*a*) adapted to penetrate into and connect the tubular member to a deck-forming member of the loading pallet, and a number of support members (3) extending at a right angle to the securing tabs and being formed, like the securing tabs, in one piece with the tubular member. The spacer is prepared from a thin-walled sheet metal portion, which has been given a polygonal tubular shape in cross section by axially extending bending zones (7) located in border areas between securing tabs (3*a*) and support members (3). Each tube wall portion (12) defined by two adjacent bending zones (7) and associated to a supporting member (3) extends at an angle to two other adjacent tube wall portions (12) located on opposite sides thereof.

4 Claims, 6 Drawing Figures

SPACER FOR LOADING PALLETS

This application is a continuation of application Ser. No. 294,516, filed Aug. 20, 1981.

The invention relates to a spacer for loading pallets, comprising a tubular member, which has, at least at one end thereof, a number of securing tabs extending generally in axial direction and adapted to penetrate into and connect the tubular member to a deck-forming member of the loading pallet, and a number of support members extending at an angle to the securing tabs and being formed, like the securing tabs, in one piece with the tubular member, which, in cross section, has a polygonal shape formed by axially extending bending zones located in the border area between tabs and support members.

Such spacers, which e.g. are known by the U.S. Pat No. 3,641,948 (FIGS. 1 and 12), should be so strong that they a.o. may resist the stresses occurring due to strokes or bumps from the forks being introduced between the deck members on lifting and lowering of the loading pallet. The spacers according to said patent do not, however, seem to be able to fulfill these requirements without use of very thick sheet material therein; this being due to the fact that the bending zones, i.e. the zones located on opposite sides of a single planar tube wall portion, only as an exception contribute to the polygonal tubular shape of the spacer, namely at a corner portion formed e.g. at every third or every second securing tab. This means that the planar sheet metal portion extending between two bending zones truly contributing to the polygonal tubular shape becomes comparatively large and thus, rather easily deformable on strokes and impacts from a fork.

This invention aims at removing this disadvantage and obtain a more rigid and economical spacer. This is obtained in that each tube wall portion defined by two adjacent bending zones and associated to a supporting member extends at an angle to two other adjacent tube wall portions located on opposite sides thereof.

With reference to the appended drawings, a more specific disclosure of an embodiment according to the invention will follow hereinafter.

Figure 2:
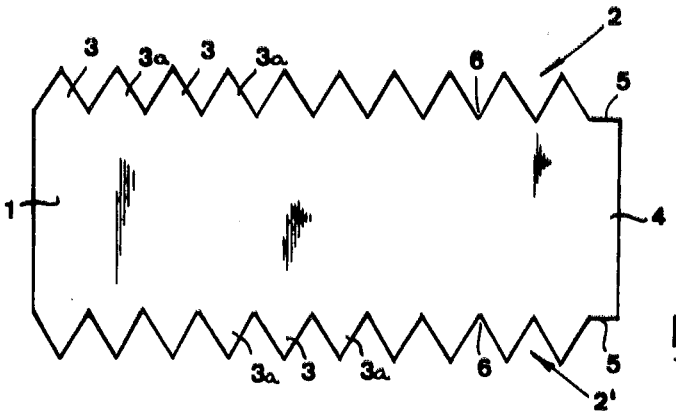
FIG. 2 is a plan view of a sheet portion, which is intended for the production of the spacer in FIG. 1 and in which a number of teeth have been stamped.

The preparation of the spacer according to the invention includes three working steps, namely punching, bending and welding. In FIG. 2, it is illustrated that a sheet metal portion 1 by punching has been provided with two sets of similar teeth 2, 2' being triangular or pointed. More specifically, each of these sets 2, 2' includes ten teeth 3, 3*a*, 3, 3*a* . . . etc. At one end of the sheet metal portion 1, a part 4 is left which at its opposite ends lacks teeth or tooth-forming portions. More specifically, this part 4 is at the top and at the bottom defined by straight border edges 5, the distance between said border edges being generally equal to the distance between the valleys 6 between adjacent teeth 3, 3*a*. In practice, the sheet metal portion 1 may be manufactured from galvanized sheet metal having a thickness of about 1 mm.

Figure 3:
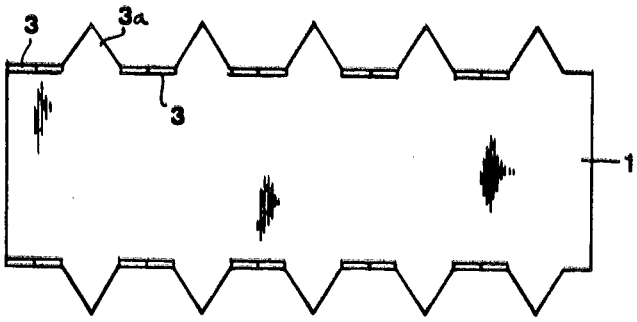
FIG. 3 is a similar plan view illustrating every second tooth bent while forming support members.

In FIG. 3 it is illustrated that every second tooth in each of the tooth sets 2, 2' has been bent at an angle, namely a right angle, to the web of the sheet portion 1. More specifically, the teeth 3 have been bent relative to the sheet web while forming support members, the intermediate teeth 3*a* having been retained uneffected while forming securing tabs suitable to be driven into wood or similar material.

Figure 1:
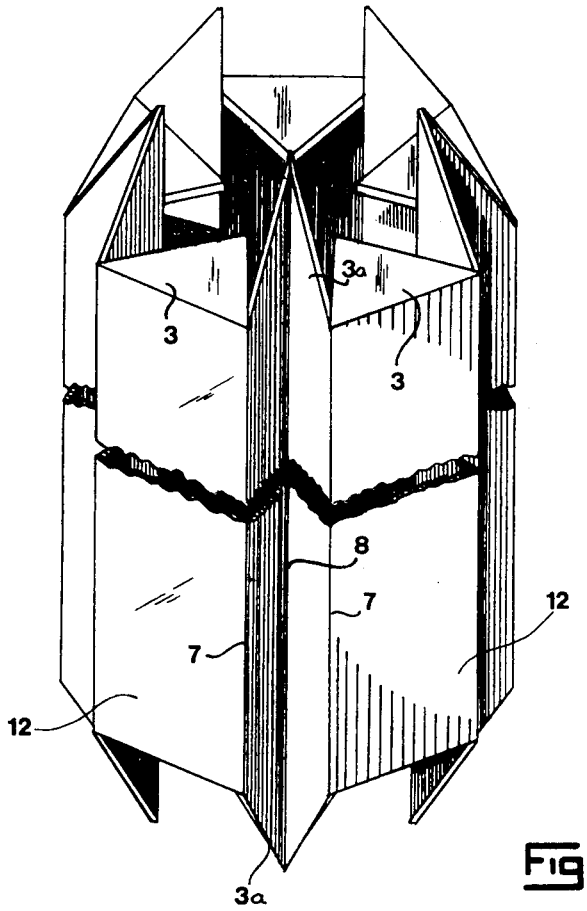
FIG. 1 is a partially cut perspective view of a spacer according to the invention.
Figure 4:
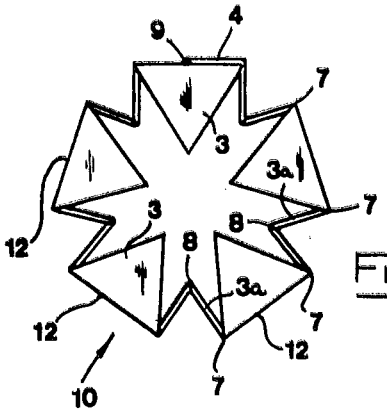
FIG. 4 is an end view of the spacer according to the invention bent to final shape.

In FIGS. 1 and 4 it is illustrated that the sheet metal portion according to FIG. 3 has been given a polygonal tubular shape in cross section by means of axially extending bending zones of two kinds, namely on one hand first bending zones 7 located in the border area between the securing tabs 3*a* and support members 3 and on the other hand second bending zones 8 extending from the points of the securing tabs generally parallel to the first bending zones 7. During this bending, the teeth 3 forming the support members are directed towards the center of the tubular member and the portions of the sheet metal web associated to the securing tab teeth 3*a* are likewise directed inwardly towards the center of the tubular member so that said second bending zones 8 are disposed more closely to the center of the tubular member than the first bending zones 7. After bending the sheet portion in accordance with FIG. 4, the end part 4 is welded to the opposite end part by one or more welds 9 of suitable kind.

In the embodiment illustrated, the number of teeth 3, 3*a* in each set is ten, which means that the number of generally planar tube wall portions 12 defined by two first bending zones 7 is five and hence it follows that the sheet portion or tubular member is given a pentagonal shape. This cross sectional shape, as well as other cross sectional shapes of higher order, i.e. with even more teeth and bending zones respectively, is preferable since the number of reinforcing, bended tube wall portions is great irrespective of where a fork hits the spacer. Each portion 12 is inclined relative to two adjacent portions 12 on opposite sides thereof. The bending zones 7 and 8 are comparatively sharp. This means that the tabs 3*a* have a generally triangular shape as viewed from above.

Figure 5:
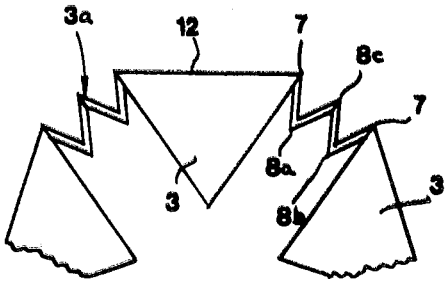
FIG. 5 is a cut end portion of a spacer according to a variation of the invention.

In FIG. 5, an alternative embodiment is illustrated in which a plurality, more specifically three, of second bending zones 8*a*, 8*b* and 8*c* is associated to each pair of securing tabs 3*a*. The two first-mentioned of these bending zones or edges point inwardly towards the center of the spacer while the latter, which extends from the point of the tab, is directed outwardly.

Figure 6:
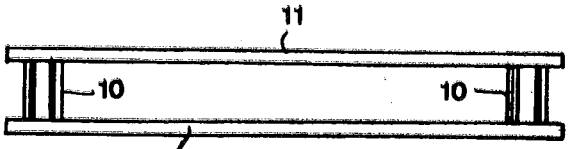
FIG. 6 is a side view illustrating a loading pallet including a spacer according to the invention.

Finally, it is illustrated in FIG. 6 that a number of spacers (preferably four located at the corners) generally denoted 10 have been provided to interconnect two deck-forming members or sheets 11 and hold these spaced from each other for the purpose of enabling introduction of the fork of a fork-lift truck between the members.

The advantages of the spacer according to the invention are numerous. By the polygonal tubular shpae in cross section, the spacer may, as mentioned above, be prepared from comparatively very thin and non-expensive sheet metal while maintaining or even improving the resistance properties of the spacer with regard to the load from the goods on the loading pallet as well as with regard to stroke or impact stresses from a truck fork. Since the tube wall portions associated to the teeth 3a forming the securing tabs are bent not only along the web of the tubular member but also along the areas forming the tabs while forming continuous bending zones between opposite tooth points, the teeth or securing tabs obtain an extremely good rigidity so that they despite low sheet thickness may safely be pressed into the sheet members 11 with no tendency to deflect. Another important advantage is that the support members 3 are bent in a direction inwardly towards the center of the spacer, for what reason their normally sharp edges are bent inwardly of the wall of the spacer where the edges cannot injure e.g. hands or clothes of the personnel having to handle the loading pallets.

The invention is obviously not limited only to the embodiment described and disclosed in the drawings. Thus, it is for instance possible to design a spacer having only one set of teeth, the spacer being connected to a sheet or deck member only at one end thereof, while the other end of the spacer is designed so that it is adapted to support directly against the ground in question. Furthermore, the number of teeth in each set may, as has been indicated, be greater than ten as illustrated in the drawings.

I claim:

1. A spacer for loading pallets, comprising a tubular member, which has, at least at one end thereof, a number of securing tabs extending generally in axial direction and adapted to penetrate into and connect the tubular member to a deck-forming member of the loading pallet, and a number of support members extending at an angle to the securing tabs and being formed, like the securing tabs, in one piece with the tubular member, which has been given a polygonal shape in cross section by means of axially extending bending edges, said bending edges being of two kinds, namely first bending edges located in the border area between each securing tab and support member and second bending edges spaced from the first bending edges and extending from the points of the securing tabs generally parallel to the first bending edges, each tube wall portion located between two adjacent first bending edges and associated to a supporting member being inclined relative to two other similar tube wall portions located adjacent the first-mentioned tube wall portion at opposite sides thereof, each of said securing tabs having portions located more closely to a longitudinal center line of the tubular member than do all first bending edges between securing tabs and support members, said securing tabs as well as said support members having the character of generally triangular teeth, every second of which, namely those forming support members, being bent at an angle to the adjacent securing tabs so as to point in a direction to the longitudinal center line of the tubular member, said securing tabs and the support members being, as viewed on a flat sheet metal blank intended for production of the spacer, generally alike, thus having generally equally wide bases adjoining to a web portion for forming said tubular member of the spacer.

2. A spacer according to claim 1, wherein the second bending edges are located closer to the center of the tubular member than the first bending edges.

3. A spacer according to claim 1, wherein the number of tube wall portions forming the polygonal shape of the tubular member and being defined by two first bending edges is at least five.

4. A spacer according to claim 1, wherein each securing tab is provided with additional axially extending bending edges.

* * * * *